United States Patent [19]

Hartmann

[11] 3,949,772

[45] Apr. 13, 1976

[54] DOOR TYPE DISHWASHER

[75] Inventor: Stanley G. Hartmann, Toms River, N.J.

[73] Assignee: General Electric Company, Carmel, Ind.

[22] Filed: Dec. 13, 1974

[21] Appl. No.: 532,380

[52] U.S. Cl. ..... 134/99; 134/103; 134/104; 134/111; 134/200

[51] Int. Cl.[2] ..... B08B 3/02

[58] Field of Search ..... 134/99, 103, 104, 111, 134/110, 200

[56] References Cited

UNITED STATES PATENTS

| | | | |
|---|---|---|---|
| 1,719,409 | 7/1929 | Webb | 134/111 X |
| 1,952,568 | 3/1934 | Schapp et al. | 134/110 X |
| 2,154,559 | 4/1939 | Bilde | 134/104 X |
| 2,619,099 | 11/1952 | Young | 134/99 X |
| 3,624,750 | 11/1971 | Peterson | 134/104 X |
| 3,669,132 | 6/1972 | Mamrose | 134/104 X |
| 3,717,159 | 2/1973 | Caviccioli | 134/104 X |
| 3,807,419 | 4/1974 | Cushing et al. | 134/104 |
| 3,868,960 | 3/1975 | Cove et al. | 134/104 X |

*Primary Examiner*—Robert L. Bleutge

[57] ABSTRACT

A dishwashing machine having a chamber to receive dishes to be washed and a sump to receive liquid for recirculation to the chamber, the sump being positioned below the chamber. The dishwashing machine includes spray arms for spraying liquid on the dishes in the chamber to carry out the washing operation, including a pre-rinse of the dishes. A divider is positioned in the cabinet to separate the chamber and the sump. The divider includes a trough extending across the chamber and a valve is located at one end of the trough. The valve is operative in conjunction with the pre-rinse action to provide for egress of pre-rinse liquid from the chamber. The trough is provided with openings, above the normal level of liquid in the trough during prerinse, to provide liquid communication between the chamber and the sump. A nozzle is located adjacent the end of the trough opposite the valve and projects water axially along the trough to assist in removing refuse from the trough. The machine includes an enclosure mounted externally of the chamber with a filter in the enclosure. Liquid flowing through the valve also flow through the filter prior to going to the drain.

14 Claims, 4 Drawing Figures

DOOR TYPE DISHWASHER

BACKGROUND OF THE INVENTION

The present invention relates to dishwashing equipment and more particularly to an improved dishwashing machine of the single chamber or door type.

One problem which commercial kitchens such as restaurants face in washing dishes is the handling of heavy refuse such as large food particles, paper napkins, etc., which may be left on dishes or may be in food preparation utensils. For many years the normal practice in commercial kitchens was to provide an area where an employee prerinsed all of the dishes by hand in order to wash off this large refuse. In the more recent past, rack conveyor type commercial dishwashers have included pre-wash sections which function to remove this large refuse prior to the wash operation. Such rack conveyor type dishwashers have a plurality of chambers and the trays of dishes are moved sequentially through the chambers. Normally to conserve water, the water proceeds through the machine in the reverse direction. That is, the water is first used to provide a final rinse, then is used to provide a first rinse of a next load of dishes; then it used to provide the washing action on another load of dishes and then is used as the pre-rinse water. Because of their multi-chamber mode of operation, rack conveyor dishwashers are capable of providing a pre-rinse so as to eliminate the need of the manual pre-wash operation.

Many smaller volume operations, such as small restaurants, do not have a sufficient volume of dishes to make it economical to use a large rack conveyor type dishwasher. Normally, they use a door type dishwasher in which a single chamber is utilized for washing and rinsing dishes, one rack at a time. With such machines it has been necessary to manually pre-wash the dishes to get rid of the larger, heavy refuse.

SUMMARY OF THE INVENTION

It is therefore an object of the present invention to provide a new and improved dishwashing machine of the single chamber type.

It is another object of the present invention to provide a single chamber type dishwashing machine which pre-rinses the dishes.

It is still another object of the present invention to provide a single chamber type dishwashing machine which eliminates large or heavy refuse from the wash chamber prior to the washing of the dishes.

In accordance with one form of the present invention there is provided a dishwashing machine comprising a cabinet structure defining a chamber to receive dishes to be washed and a sump to receive liquid for recirculation to the chamber, the sump being positioned below the chamber. Means are provided for spraying liquid on the dishes in the chamber to provide a washing operation of the dishes, including a pre-rinse of the dishes. A divider is positioned within the cabinet and separates the chamber and the sump. The divider includes a trough extending substantially across the chamber. Valve means is provided at one end of the trough and is operative in conjunction with the pre-rinse action to provide egress of pre-rinse liquid from the chamber.

DESCRIPTION OF THE PREFERRED EMBODIMENTS

Figure 1:
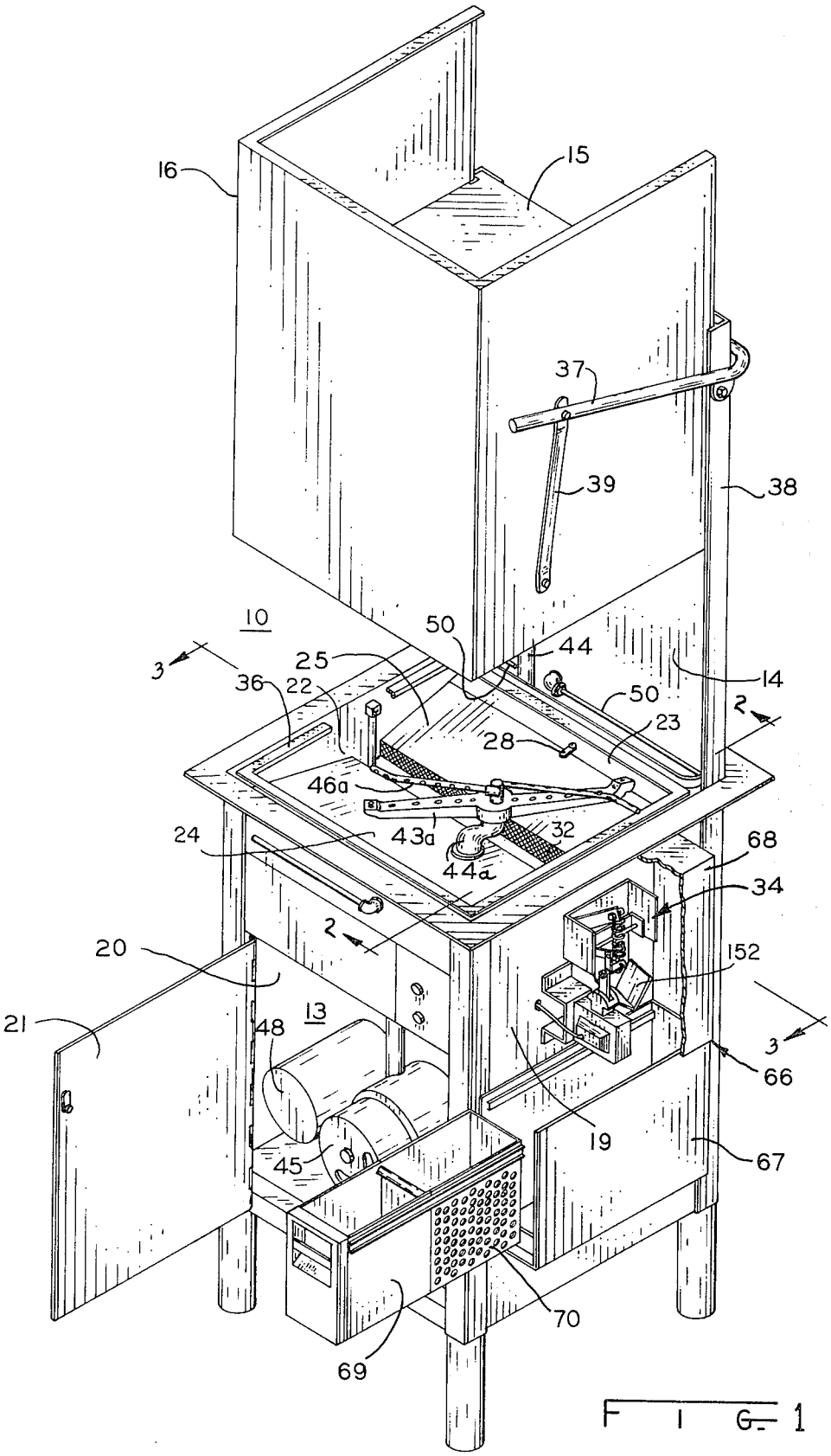
FIG. 1 is a somewhat simplified, perspective view of a single chamber dishwasher incorporating one form of the present invention, with some parts omitted and some parts broken away for purposes of illustration.

Referring now to the drawings there is illustrated, in somewhat simplified form, a single chamber or door type dishwashing machine incorporating one form of the present invention. A single chamber door type dishwashing machine is designed to wash one rack of dishes at a time with the complete washing operation being conducted sequentially in the same chamber. It will be understood that the term "dishes" is used in its broad sense. It includes chinaware, glassware, and silverware used by the customer as well as the various utensils and implements used in the preparation of food.

The illustrative dishwashing machine 10 includes a housing defining a washing chamber 11, a water receiving or storage sump 12 and a machinery compartment 13. The wash chamber 11 is generally defined by a backwall 14, top wall 15, and a U-shape door 16. The sump 12 is generally defined by the backwall 14, bottom wall 17, an intermediate wall 18, and side walls 19 and 20. The machinery compartment 13 is generally defined by the bottom wall 17, side walls 19 and 20 and a front wall 21 which may be in the form of a door to provide access to the machinery compartment. The wash compartment or chamber 11 is separated from the sump and machinery compartment by means of a divider generally indicated at 22. The divider includes a rear stationary section 23, a front stationary section 24, and a removable section 25. The removable section includes a pair of hinges, one of which is shown at 26, that fit on pins 27 extending inwardly from the sides of the housing. The removable section overlaps the rear section 23 and underlaps the front section 24 and is removably held in place by a small tab or key 28. When it is desired to remove the removable section, in order to thoroughly clean the sump 12 for instance, the tab 28 is moved out of interferring relationship with the removable section. The removable section then is pivoted slightly around the pins 27 and lifted out of the machine.

The removable section 25 includes a trough 30 having a generally V-shaped lower wall 31 forming a lower, imperforate section and a pair of generally vertical sidewalls 32 and 33. The vertical walls 32 and 33 have holes provided therein to provide liquid communication between the wash chamber 11 and the sump 12. The trough is canted or sloped as it extends from side to side within the housing so that it is deepest adjacent valve mechanism generally indicated at 34. The valve mechanism is designed to selectivly close an opening 35 (FIG. 4) in the side wall 19. With this arrangement, when the valve is open water received in the trough will flow out of the housing through the opening 35. On the other hand, when the valve mechanism 34 is closed water will not flow through the opening 35. The V-shaped bottom wall of the trough 30 is sufficiently deep that when the valve mechanism is open during the pre-rinse operation the water received within the trough will flow through the V-shaped portion and will not rise to a depth sufficient to overlap the vertical walls 32 and 33.

Figure 2:
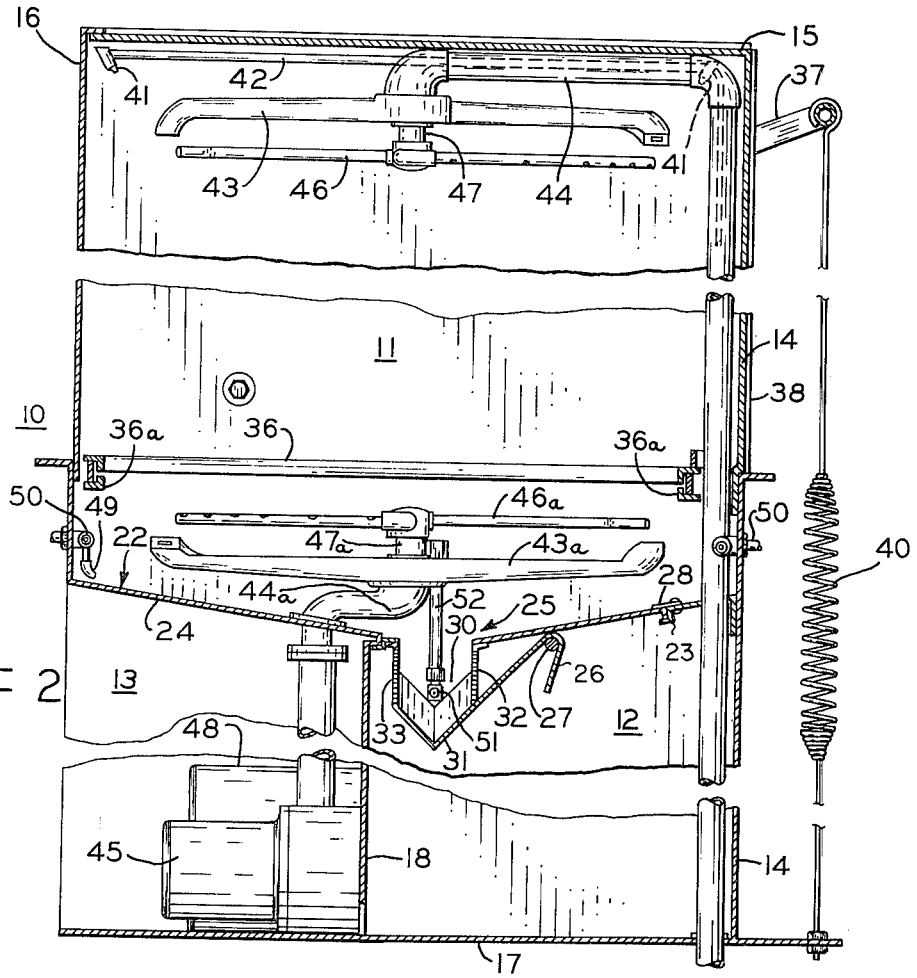
FIG. 2 is a cross-sectional view of the machine illustrated in FIG. 1 generally as taken along line 2—2 in FIG. 1.

Dishes to be washed are placed in a suitable rack, as is well known in the art. The rack is supported in the wash chamber 11 on the generally rectangular support frame 36. The support frame is mounted in the wash chamber by means of brackets 36a positioned adjacent each of the corners of the housing. The U-shaped door 16 is moved between its open position (as shown in FIG. 1) for the insertion and removal of dishes and its closed position (as shown in FIG. 2) for closing the wash chamber 11 by means of a U-shaped handle 37, which is pivotally attached to angle irons 38 at each of the rear corners of the machine. Each side or arm of the handle 37 is rotatably connected to the adjacent side of the door 16 by means of a pivoted linkage 39. The rear or base portion of the handle 37 is attached to a spring mechanism 40 which, in turn, is attached to the base of the machine. The handle 37 and spring mechanism 40 form an overcenter spring arrangement. Thus the spring mechanism 40 biases the door to both its closed and open positions.

If desired, the handle and spring mechanism could be arranged so that the spring mechanism biases the door to a slightly open or ajar position. A lock mechanism then would be included to hold the door closed during a washing operation. The lock could be designed to release the door at the end of a washing operation. This would allow the door to open slightly to let out excess steam and serve as an end of cycle indicator.

The illustrative machine includes multiple spraying mechanisms for accomplishing pre-rinsing, washing and rinsing of the dishes. The pre-rinse is accomplished by four nozzles 41 (only two of which are shown in FIG. 2) located adjacent each of the upper corners of the washing chamber 11. These nozzles are connected to suitable source of water by pipes 42. Washing is accomplished by rotatable spray arms 43 and **43*a* located adjacent the top and bottom portions of the washing compartment. The spray arms 43 and 43*a* are connected by pipes 44 and 44*a* respectively to a portion of pump unit 45. The pump unit is connected to the sump 12 to draw wash liquid from the sump and deliver it to the arms 43 and 43*a*. Rinsing is accomplished by rotatable spray arms 46 and 46*a* which are mounted concentrically with spray arms 43 and 43*a*. Pipes 47 and 47*a* connect spray arms 46 and 46*a* to another portion of pump unit 45. This portion of the pump unit is connected to a booster water heater 48. The booster water heater serves to raise the temperature of incoming fresh water to a suitable level (normally about 180° F). It will be understood that with appropriate valving a single pump unit can be used to selectively deliver water from sump 12 to spray arms 43 and 43*a* and from booster water heater 48 to spray arms 46 and 46*a***.

The machine also includes additional spray nozzles 49 (only two of which are shown in FIG. 2) located adjacent each of the lower corners of the washing chamber 11. These additional spray nozzles are connected to a suitable source of water by pipes 50 and are arranged to spray sheets of water across the upper surface of the divider 22 during pre-rinse. This action will wash any large items of refuse such as large pieces of food, pieces of paper napkin, etc. into the trough 30. A nozzle 51 is positioned at the end of the trough 30 remote from the valve mechanism 34. It is connected to a source of water by pipe 52 and directs a stream of water generally axially through the trough toward the valve mechanism 34 during the pre-rinse operation. This helps flush large particles of refuse through thr trough and out of the wash chamber through the opening 35. Conveniently, the nozzles 41, 49 and 51 are connected to the source of fresh water through a control valve (not shown) so as to conserve energy. However, if desired, at least the nozzles 41 can be connected to the booster water heater to accomplish pre-rinse with hot water.

During a typical cycle of operation of the illustrative machine, a rack of dishes is placed in the machine on the frame 36 and the door 16 is closed. First water is admitted to the machine under pressure so as to spray from the pre-rinse nozzles 41, from the additional spray nozzles 49 and from the nozzle 51. During this operation the valve mechanism 34 is open. The streams of water from nozzles 41 rinse excess particles of refuse from the dishes and the particles fall to the divider 22. The water from the additional nozzles 49 helps wash the refuse across the divider 22 into the trough 30. The additional stream of water from the nozzle 51 helps propel the refuse along the trough and out of the wash chamber through the opening 35. At the end of the pre-rinse operation the external water supply to these nozzles is interrupted and the valve mechanism 34 closes.

Thereafter, washing liquid is drawn from the sump 12 by the pump 45 and is expelled through the wash spray arms 43 and **43*a* to wash the dishes. The washing action may continue for several minutes. The water sprayed into the washing chamber or compartment 11 flows downwardly to the divider 22 and into the trough 30. Since the valve mechanism 34 is closed, the water will build up in the trough so as to at least partially cover the vertical walls 32 and 33. Since the walls 32 and 33 are perforated, the water will flow through these perforations or openings back into the sump 12. Thus, the water is recirculated between the sump and the washing chamber. It will be understood that an automatic dispensing mechanism (not shown) may be included in the machine for automatically adding suitable detergent to the water in the sump 12. Also, in order to insure that the water and detergent solution in the sump 12** is maintained at a proper washing temperature a heater is included to heat the wash solution in the sump. The sump heater has not been shown for the sake of simplicity.

Subsequently additional fresh water, which has been heated to about 180° F by booster heater 48, is sprayed from the rinse spray arms 46 and **46*a* in order to rinse the dishes. This water also falls to the divider and flows through the openings in the vertical walls 32 and 33 into the sump 12. Conventionally, the sump will be provided with a combination overflow and full drain mechanism (not shown). During rinse operation water flows into the sump. This tends to raise the level of water above the overflow opening. Water drains out through the overflow opening. This action carries off small refuse particles and scum, which tend to float on the top of the body of water in the sump. At the end of several complete cycles, as at the end of a meal period, the full drain is opened to completely drain the sump. It will be understood that a small amount of rinse water may accumulate in the V-shaped bottom section of the trough. However, this water will quickly drain from the machine as soon as the valve mechanism 34** opens for the next pre-rinse operation.

It also will be understood that the valve mechanism 34 can be opened, either partially for fully, at other times during the cycle of operation of the machine if desired. For instance, the valve mechanism can be opened briefly near the end of the washing step. Some of the wash solution will flow out of the machine. It will carry with it additional refuse removed from the dishes during the wash step, which refuse is too large to go through the openings in vertical walls 32 and 33. Also, the valve mechanism can be partially opened during the rinse step, allowing part of the rinse water to drain directly from the machine. This will reduce the amount of rinse water entering the sump and thus reduce the dilution of the wash solution. At the same time it is generally advisable to have some overflow from the sump to carry off floating refuse and scum.

Figure 4:
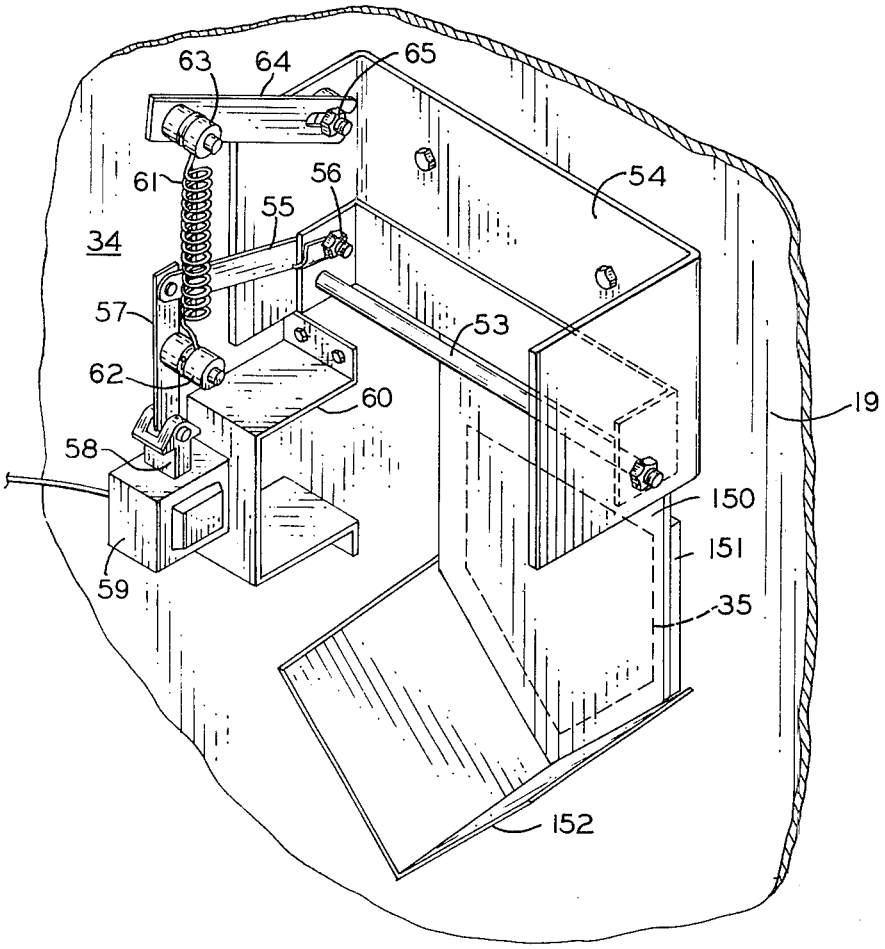
FIG. 4 is an enlarged fragmentary perspective view illustrating certain details of the valve mechanism utilized in the machine of FIG. 1.

Referring now particularly to FIG. 4, it will be seen that the valve mechanism 34 includes a valve plate 150 which carries a gasket 151. When the valve plate 150 is in its closed position (as seen in FIG. 4) the gasket 151 covers the opening 35 (shown by phantom lines) in side wall 19 so that no liquid will flow out of the wash chamber 11. When the valve plate 150 is moved to its open position, the gasket 151 is way from the opening 35 and water may flow from the wash chamber 11 and through V-shaped trough extension 52. In order to be moved between its open and closed positions, the valve plate 150 is rotatably mounted about an elongated bolt 53. The bolt is held by a U-shaped bracket 54, which, in turn, is mounted to the wall 19. A crank arm 55 is connected to the valve plate 150 by nut and bolt 56 at a location offset from bolt 53 so that movement of the crank arm 55 will cause the valve plate 150 to rotate about the bolt 53.

The opposite end of the crank arm 55 is rotatably connected to one end of an actuating arm 57. The other end of the actuating arm 57 is connected to the plunger 58 of an electric solenoid or electro-magnet 59. The solenoid mechanism 59 may be mounted to the side wall 19 by means of a bracket 60. A spring 61 has one of its ends connected to a mounting pin arrangement 62, which is provided at an intermediate position of the actuating arm 57, and its other end connected to a mounting pin arrangement 63 that is provided at one end of a stationary arm 64. The other end of the stationary arm is mounted to the bracket 54 by nut and bolt arrangement 65. The nut and bolt arrangement 65 allows the position of the arm 64 to be moved in order to set an appropriate amount of tension on the spring 61.

The spring 61 tends to move the actuating arm 57 upwardly (as seen in FIG. 4), which will cause the valve plate 150 to move to its closed position. Energization of the solenoid 55 pulls in the plunger 58 and moves actuating arm 57 downwardly against the tension of the spring 61 so as to move the valve plate 150 to its open position. Thus the valve plate 150 is open (away from opening 35) whenever the solenoid 59 is energized and is closed (covering opening 35) when the solenoid is de-energized.

Figure 3:
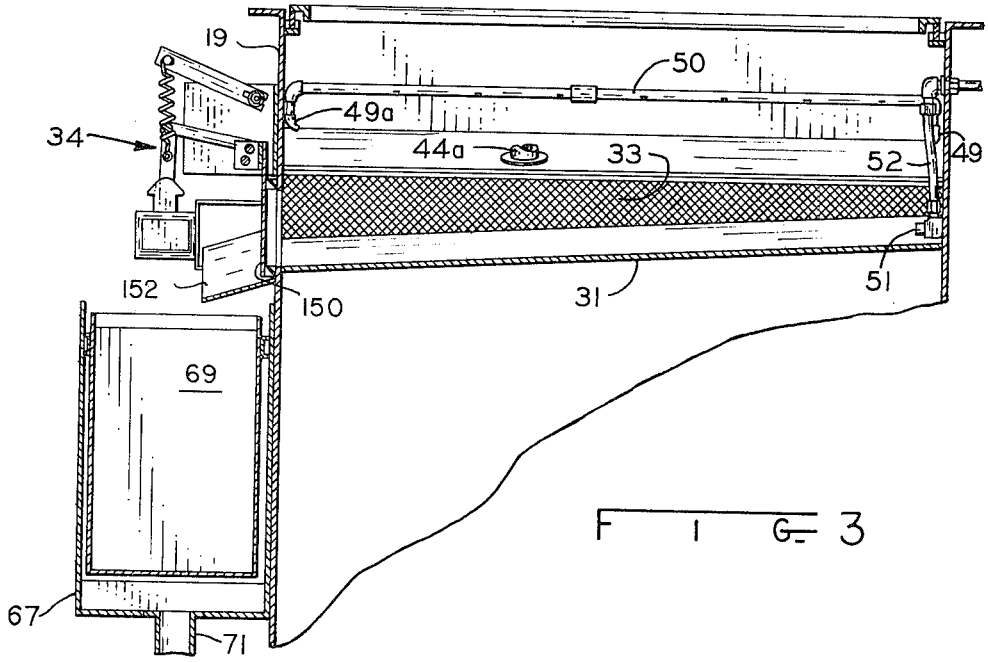
FIG. 3 is a partial cross-sectional view of the lower portion of the machine illustrated in FIG. 1 generally as taken along line 3—3 in FIG. 1.

Referring now to FIGS. 1 and 3, it will be seen that the valve mechanism 34 is received in an enclosure generally indicated at 66. The enclosure 66 is formed by lower member 67 and an upper member 68 which are attached to the side wall 19 of the housing. It will be understood that the enclosure may be made a unitary structure. The two-member structure illustrated facilitates service of the valve mechanism 34 as only the upper member 68 need be removed for service. A removable filter 69 is slidably received in the lower enclosure member 67 so that the perforated portion 70 of the filter is positioned below the trough extension 152. A drain attachment 71 is connected to the bottom of the lower enclosure member 67. With this arrangement water and refuse flowing out of the trough 30 falls into the filter 69. The water flows through the openings in the perforated section 70 and through the drain attachment 71 to an appropriate drain. The filter 69 filters out the refuse so it will not clog the drain. Periodically, the filter 69 may be slid out of the enclosure 66 and emptied of refuse. The provides a substantial advantage as the large refuse washed from the dishes during the pre-rinse operation accumulates much faster than refuse washed from the dishes during the washing operation and thus the pre-rinse refuse should be disposed of much more often than the machine needs to be cleaned. The present arrangement allows this refuse to be disposed of without the necessity of cleaning any of the main portion of the dishwashing machine.

It should be apparent to those skilled in the art that while I have described what, at present is considered to be the preferred embodiments of this invention, in accordance with the patent statutes; changes may be made in the disclosed apparatus without departing from the invention. It is intended in the appended claims to cover all such changes and modifications as come within the true spirit and scope of the invention.

What I claim as new and desire to secure by Letters Patent of the United States is:

1. A dishwashing machine comprising:

a. a cabinet structure defining a chamber to receive dishes to be washed and a sump to receive liquid for recirculation to said chamber; said sump being positioned below said chamber;

b. means for spraying liquid on dishes in said chamber to provide a washing operation on the dishes, including a pre-rinse of the dishes;

c. a divider positioned within said cabinet and separating said chamber and said sump, said divider including a trough extending substantially across said chamber; and d. valve means at one end of said trough and operative in conjunction with at least the pre-rinse action to provide for egress of liquid from said chamber.

2. A dishwashing machine as set forth in claim 1 further comprising means positioned externally of said cabinet for filtering liquid egressing from said chamber.

3. A dishwashing machine as set forth in claim 1, further comprising:

a. an enclosure mounted externally of said chamber, said valve means providing for selective liquid flow from said chamber to said enclosure in conjunction with at least the pre-rinse action;

b. a filter removably mounted in said enclosure to receive liquid flowing from said chamber to remove refuse from the liquid; and c. means for connecting said enclosure to a drain.

4. A dishwashing machine as set forth in claim 1 further including discharge means positioned to direct a stream of liquid generally axially of said trough toward said valve means to assist in removing refuse from said trough.

5. A dishwashing machine as set forth in claim 4 including additional discharge means for directing liquid across said divider during pre-rinse.

6. A dishwashing machine as set forth in claim 5, wherein said trough includes at least one substantially vertical wall portion, above the normal level of pre-rinse liquid in said trough, said at least one substantially vertical wall portion having openings to provide for flow of liquid from said chamber to said sump.

7. A dishwashing machine as set forth in claim 1 wherein said divider is substantially imperforate and said trough has openings, above the normal level of pre-rinse liquid in said trough to provide for flow of liquid from said chamber to said sump.

8. A dishwashing machine as set forth in claim 1 wherein a section of said divider, including said trough, is removable from said cabinet.

9. A dishwashing machine comprising:

a. a cabinet structure defining a chamber to receive dishes to be washed and sump to receive liquid for recirculation to said chamber; said sump being positioned below said chamber;

b. spray means for spraying liquid on the dishes to wash and to rinse the dishes;

c. additional spray means for spraying liquid on the dishes to pre-rinse the dishes;

d. a divider forming the bottom wall of said chamber; said divider including an elongated trough to receive liquid sprayed on the dishes; and e. valve means provided and one end of said trough and selectively operable to provide for egress of liquid from said chamber.

10. A dishwashing machine as set forth in claim 9, further comprising:

a. an enclosure mounted externally of said chamber, said valve means providing for selective liquid flow from said chamber to said enclosure;

b. a filter removably mounted in said enclosure to receive liquid flowing from said chamber to remove refuse from said liquid; and c. means for connecting said enclosure to a drain.

11. A dishwashing machine as set forth in claim 9, wherein: said trough includes a lower imperforate section and at least one perforated wall section above said imperforate section; said at least one perforated wall section providing for flow of liquid from said chamber to said sump; said imperforate section of said trough being sufficiently large that when said valve is open, the liquid received in said trough during pre-rinse of the dishes will not rise to the level of said at least one perforated wall section.

12. A dishwashing machine as set forth in claim 9 further including discharge means positioned to direct a stream of liquid generally axially of said trough toward said valve means to assist in removing refuse from said trough.

13. A dishwashing machine as set forth in claim 12 including additional discharge means for directing liquid across said divider during pre-rinse.

14. A dishwashing machine as set forth in claim 9, wherein: said divider includes spaced apart stationary sections; and said trough is pivotably mounted for movement between a position in interfering relationship with said stationary sections to complete said divider and a position clear of said stationary sections for removal from said machine.

* * * * *